United States Patent [19]

Sakamaki et al.

[11] Patent Number: 4,595,347

[45] Date of Patent: Jun. 17, 1986

[54] ROTARY COMPRESSOR

[75] Inventors: Hiroshi Sakamaki, Utsunomiya; Susumu Sugishita, Hanyu; Yukio Horikoshi, Kazo; Kikuji Yanagihashi, Yono, all of Japan

[73] Assignee: Nippon Piston Ring Co., Ltd., Tokyo, Japan

[21] Appl. No.: 616,813

[22] Filed: Jun. 4, 1984

[30] Foreign Application Priority Data

Jun. 9, 1983 [JP] Japan ..... 58-101713

[51] Int. Cl.[4] ..... F04C 18/348

[52] U.S. Cl. ..... 418/173

[58] Field of Search ..... 418/173, 71; 308/DIG. 1; 381/100, 109, 110, 114, 118, 400

[56] References Cited

U.S. PATENT DOCUMENTS 2,918,877 12/1959 Woodcock ..... 418/71

4,479,763 10/1984 Sakamaki et al. ..... 418/144

FOREIGN PATENT DOCUMENTS 203291 5/1959 Austria ..... 308/DIG. 1

OTHER PUBLICATIONS

Chironis, N.; Gas Bearings; Product Engineering; Nov. 23, 1959; pp. 68–70.

*Primary Examiner*—Leonard E. Smith

*Attorney, Agent, or Firm*—Birch, Stewart, Kolasch & Birch

[57] ABSTRACT

A rotary compressor is provided with a rotary sleeve mounted in a center housing for rotation with a plurality of vanes movable in a rotor which is eccentrically disposed in the rotary sleeve. An air-bearing room is defined between the outer periphery of the rotary sleeve and the inner periphery of the center housing and supplied with air through an inlet internally connected to the discharge chamber or compression working space under the maximum pressure. A multiplicity of air-accumulating grooves are formed in either or both in the outer periphery of the rotary sleeve and the inner periphery of the center housing.

The air-accumulating groove is composed of a suction portion gradually inclined from the peripheral direction and a compression portion sharply inclined from or perpendicular to the peripheral direction. The inlet is peripherally alined with the suction portion of each air-accumulating groove, so that air is guided to the suction portion and compressed in the compression portion of the groove to increase the bearing effect of the air-bearing room.

11 Claims, 15 Drawing Figures

ROTARY COMPRESSOR

BACKGROUND OF THE INVENTION

1. FIELD OF THE INVENTION

The present invention relates to a rotary compressor which is utilizable as a supercharger for an internal combustion engine and provided with a rotary sleeve mounted in a center housing for rotation with a plurality of vanes movable in a rotor which is eccentrically disposed in the rotary sleeve.

2. DESCRIPTION OF THE PRIOR ART

The inventors of this application has proposed a novel rotary compressor in Japanese Patent Application serial No. Sho 57-216293, in which a multiplicity of air-accumulating grooves are formed in either or both of the inner periphery of the center housing and the outer periphery of the rotary sleeve and separated from one another to prevent the rotary sleeve from directly contacting and scuffing the inner periphery of the center housing when the compressed air in the compression working space pushes the rotary sleeve from within to the compression side inner periphery of the center housing. lhe inventors have also proposed another rotary compressor in Japanese Patent Application Serial No. Sho 58-28608 in which the air-bearing room between the inner periphery of the center housing and the outer periphery of the rotary sleeve is supplied with air through an inlet which is internally connected to the discharge chamber, the compression working space confined among the rotor, the rotary sleeve and the adjacent vanes, or the open air. The supplied air flows along an area of the inner periphery of the center housing to which the rotary sleeve is pushed, resulting in that the bearing effect is increased on the area. Meanwhile, there has been found a relationship between the inlet and the air-accumulating groove forimproving the air-bearing effect of the air-bearing room.

SUMMARY OF THE INVENTION lt is the primary object of the present invention to provide a rotary compressor in which the rotary sleeve is floatingly supported by an air-bearing room which is defined between the outer periphery of the rotary sleeve and the inner periphery of the center housing and provided with a multiplicity of air-accumulating grooves and at least an inlet for supplying air into the air-bearing room.

To attain the object as described above, the present invention is directed to a rotary compressor comprising a center housing, a rotary sleeve mounted for rotation in the center housing, a plurality of vanes movably disposed in a rotor which is eccentrically disposed in the rotary sleeve, a multiplicity of air-accumulating grooves formed in either or both of the inner periphery of the center housing and the outer periphery of the rotary sleeve and separated from one another, suction and discharge chambers, and at least an inlet formed on the inner periphery of the center housing and internally connected to one of the discharge chamber and the compression working space confined among the rotary sleeve, the rotor and the adjacent vanes, wherein the air-accumulating grooves have the suction parts thereof peripherally aligned with the inlet.

The inlet is desirably shaped in the form of a peripherally extending groove to guide air into the air-accumulating groove with the least mount of air resistance. The air-accumulating groove preferably has the suction part thereof gradually inclined and the compression part thereof sharply slanted with respect to the peripheral direction in order to prohibit the backward flowing of air once it has entered into the air-accumulating groove.

A part of the air supplied through the inlet always flows upstream toward the suction side. But, the upstream air is utilized to increase the bearing effect of the air-bearing room by an air pocket formed in the suction side, inner periphery of the center housing.

The advantages offered by the present invention are mainly that the air-bearing room has an increased effect to floatingly support the rotary sleeve and that the compressor needs less torque. Air is injected to the suction part of the air-accumulating groove through the inlet peripherally alined with the suction part and compressed in the compression part to increase the bearing effect of the air-bearing room.

BRIEF DESCRIPTION OF THE DRAWINGS

The apparatus of the present invention is described in detail below with reference to drawings which illustrate preferred embodiments, in which.

DETAILED DESCRIPTION OF THE INVENTION

Figure 1:
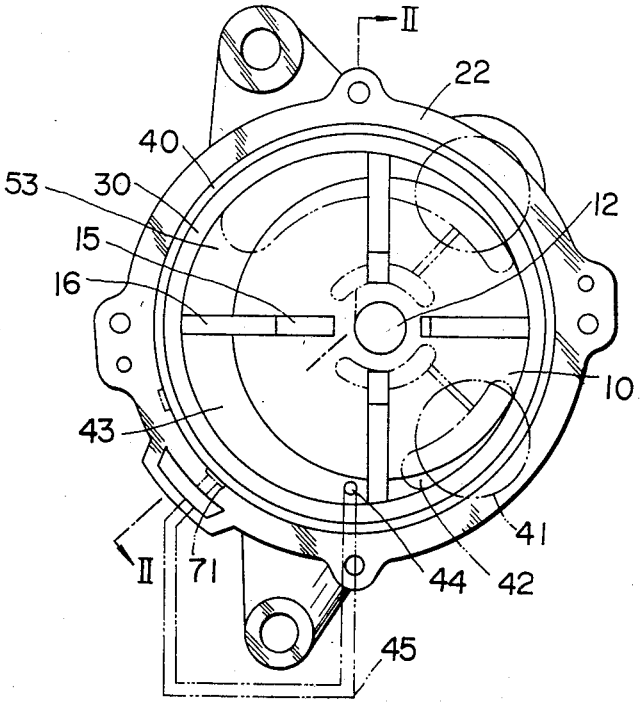
FIG. 1 is a side elevation of the rotary compressor of the present invention, the rear side housing of which is removed for convenience.

As seen in FIG. 1, the compressor has a center housing 22, a rotary sleeve 30 mounted in the center housing, and rotor 10 eccentrically disposed in the rotary sleeve 30. A plurality of vanes 16 are radially movable in the respective vane grooves 15 in the rotor 10 and each has its apex in contact with the inner periphery of a rotary sleeve 30. The rotary sleeve 30 and the center housing 22 define an air-bearing room 40 therebetween, the width of which is exaggeratedly illustrated but really less than 0.1 mm. Two adjacent vanes 16, while turning, forms a comprssion working space 43 in the compression side and a suction working space 53 in the suction side of the compressor, respectively. The compression working space 43 has its maximum pressure immediately before being internally connected to the discharge chamber 41 through the discharge port 42. An extract port 44 is provided to extract the maximum pressure air from the compression working space. An inlet 71 is provided in an area of the compression side inner periphery of the center housing 22 to which the rotary sleeve 30 is pushed from within by compressed air in the compression working space 43 and connected to the extract port 44 through the intermediary of an air-supply passage 45 with an accumulator. The rotor 10 is fixed to a shaft 12.

Figure 2:
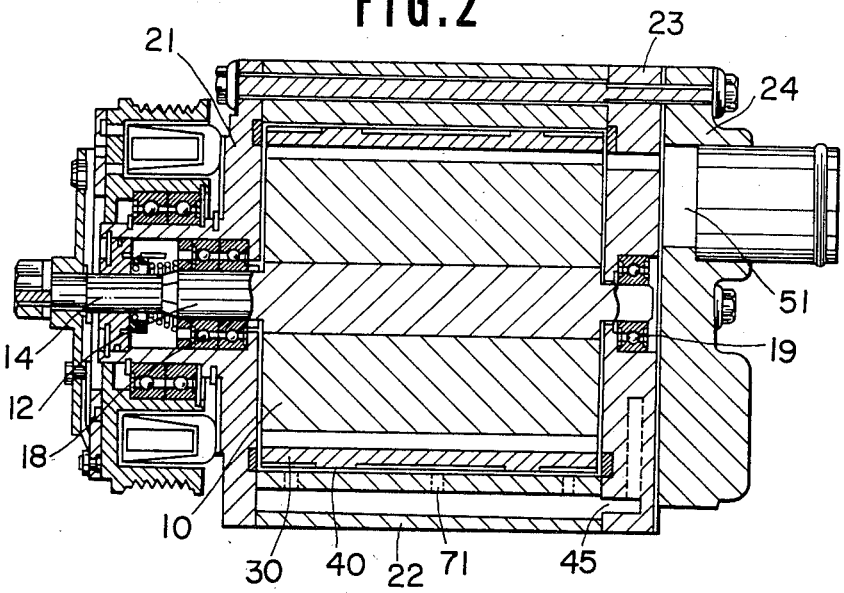
FIG. 2 is a section taken along the line II—II of FIG. 1.

As seen in FIG. 2, the compressor has the rotor 10 integrally provided with the shaft 12 rotatably supported by bearings 18, 19 in the respective front and rear side housings 21, 23 and fixed at the front end thereof to a pulley 14 which is rotated by an engine (not shown). A gasket is interposed between the rear side housing 23 and the rear cover 24 in which the discharge chamber (not shown) and the suction chamnber 51 are provided. The air-suppy passage 45 is connected to the inlet 71 which is opened to the air-bearing room 40 between the inner periphery of the center housing 22 and the outer periphery of the rotary-sleeve 30.

Figure 3:
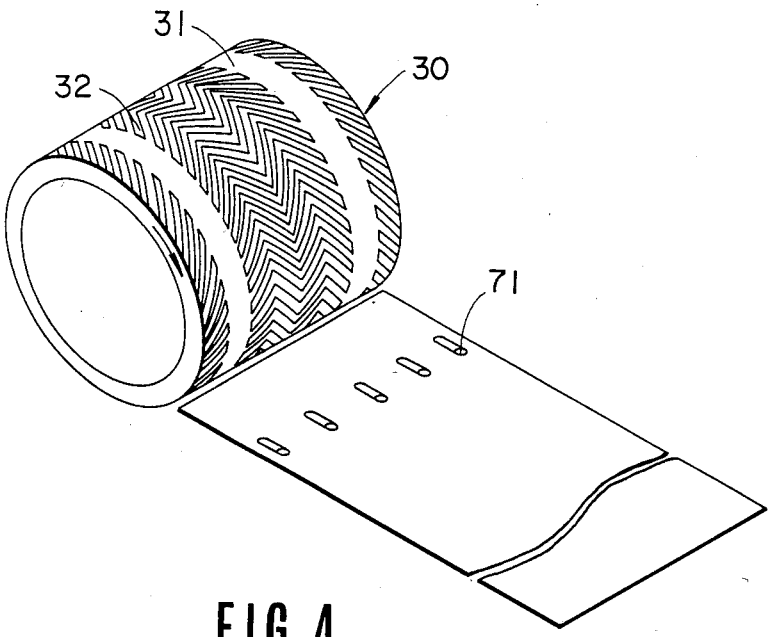
FIG. 3 is a pictorial view of the rotary sleeve and a part of the developed inner periphery of the center housing of FIGS. 1 and 2, illustrating the air-accumulating groove and the inlet.

As seen in FIG. 3, the rotary sleeve 30 has a multiplicity of air-accumulating grooves 32 formed in its outer periphery 31 by an electrolytical etching or shot-blast method. The air-accumulating grooves in ihe opposite sides of the rotary sleeve 30 are simply slanting, those in the center being W-shaped. The air-accumulating grooves 32 are peripherally aligned with and separated from one another, thereby being herringbone shaped, as a whole, to have the end and turning portions thereof disposed on given circular lines coaxial with the rotary sleeve 30. Upon rotation of the rotary sleeve 30 in the direction shown by an arrow, the end and turning portions of the air-accumulating groove 32 in the rotational side serve as the suction portions for the suction of air, the opposite end and turning portions being effective as compression portions for compression of air. Five inlets 71 in the compression side inner periphery of the center housing 22 are peripherally aligned with five series of the suction parts of the air-accumulating grooves 32 in the outer periphery of the rotary sleeve 30. Each inlet 71 is shaped in the form of a peripherally extending groove into which air is smoothly guided.

Figure 4:
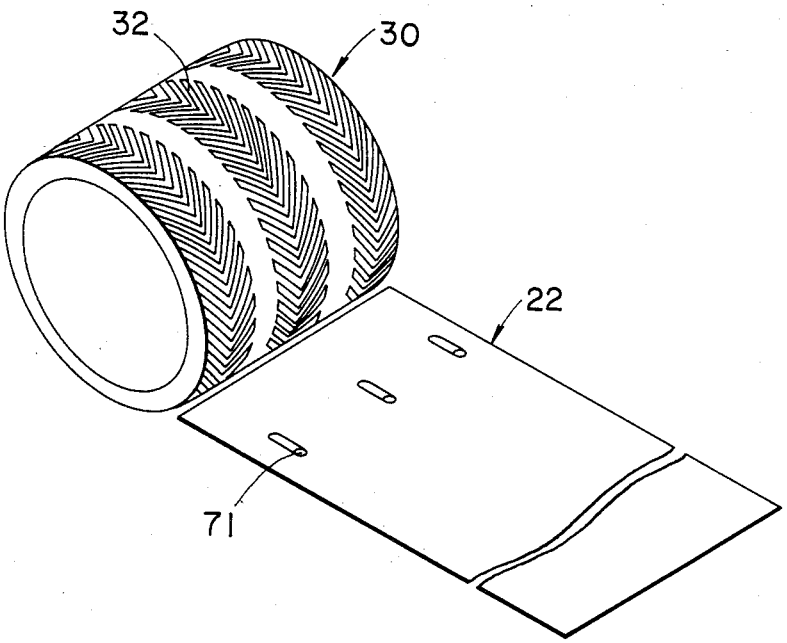
FIGS. 4 to 9 are views, of different embodiments, similar to FIG. 3.
Figure 5:
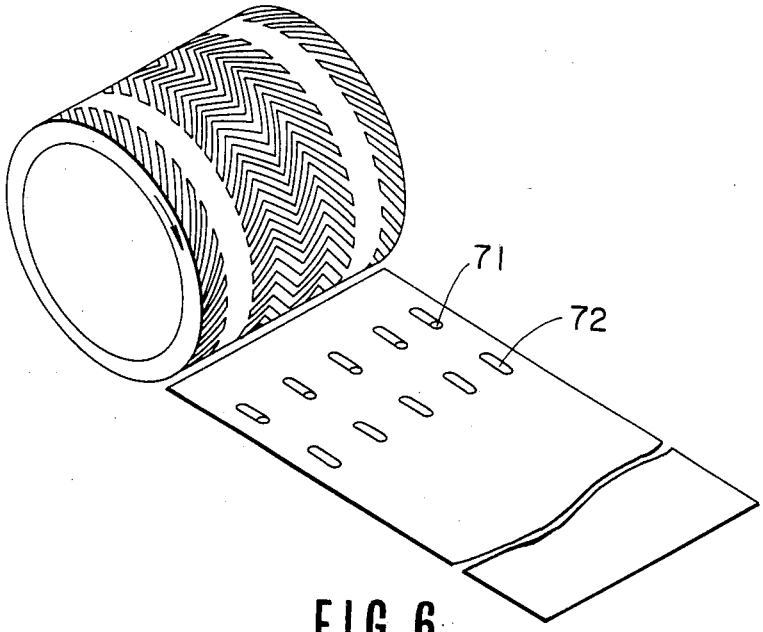

The air-accumulating grooves are not limited to there of FIG. 3 but can be shaped in a variety of herringbone forms. The rotary sleeve 30 of FIG. 4 has its air-accumulating grooves 32 composed of three V-shaped grooves 32, the suction portions of which are peripherally aligned with the inlets 71 in the inner periphery of the center housing 22. In the embodiments of FIGS. 3 and 4, the air, supplied to the air-bearing room through the inlets, mostly flows downstream but partly leaks upstream. The leaking air serves to increase the bearing eifect through the intermediary of the pockets 72 formed above the inlets 71 in the inner periphery of the center housing, in the embodiments of FIGS. 5 and 6. In preference, the pocket 72 is peripherally aligned with the inlet 71. For example, the inlet and the pocket are respectively disposed on an area subtended to an angle of 0 to 45 degrees and on another area subtended to an angle of 45 to 90 degrees measured upstream from the starting point of the compression side, inner periphery of the center housing. The pocket may be formed in the suction side inner periphery of the center housing for increasing the bearing effect in the suction side.

Figure 7:
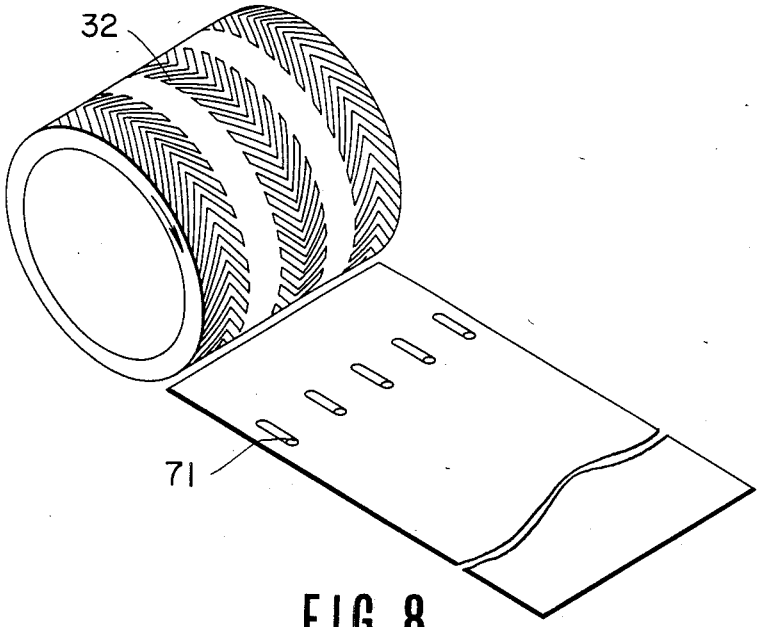
Figure 8:
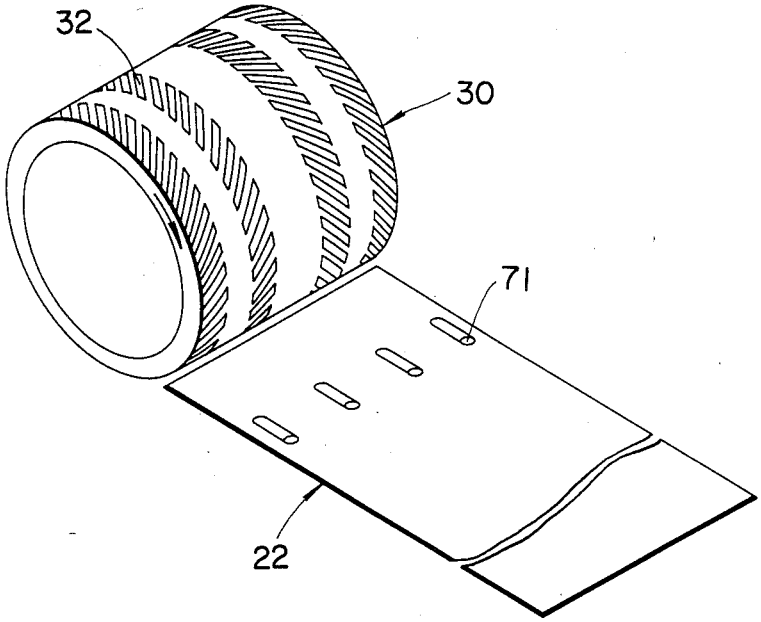
Figure 9:
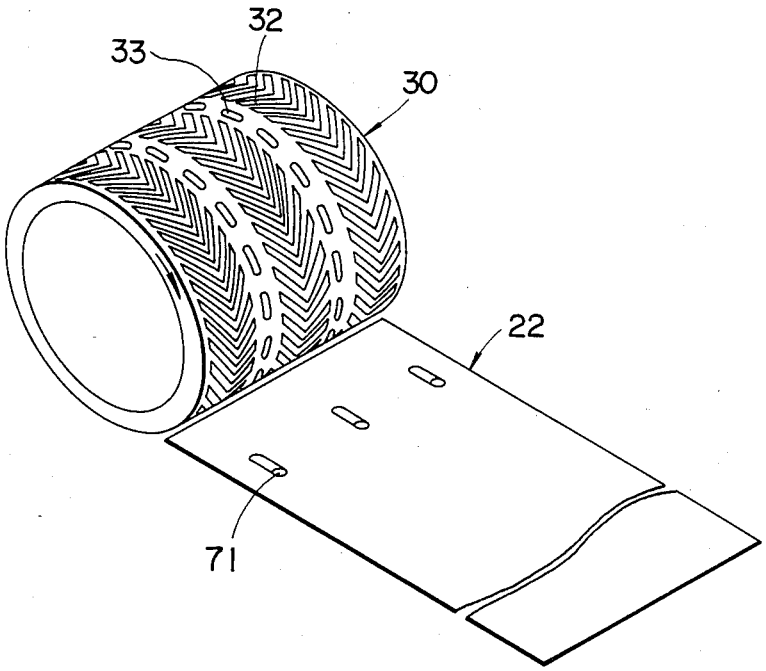

The rotary sleeve 30 of FIG. 7 is provided with air-accumulating grooves 32 consisting of a central group of V-shaped grooves and opposite groups of inversely V-shaped grooves, the suction portions of the grooves and the inlet 71 in the center housing 22 being disposed on five parallel circles. The rotary sleeve 30 of FIG. 8 has four groups of slanting grooves 32 to which four inlets 71 open on the inner periphery of the center housing 22. The rotary sleeve 30 of FIG. 9 has three groups of herringbone grooves 32 and two groups of relatively deep dimples 33, but three inlets 71 are directed only to herringbone grooves 32.

Figure 10:
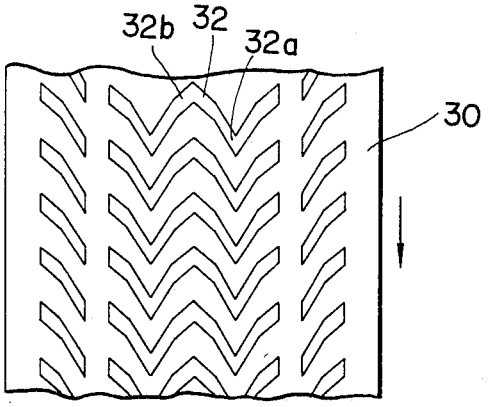
FIGS. 10 and 11 are developed views of further different embodiments, illustrating a part of the outer periphery of the rotary sleeve, respectively.
Figure 11:
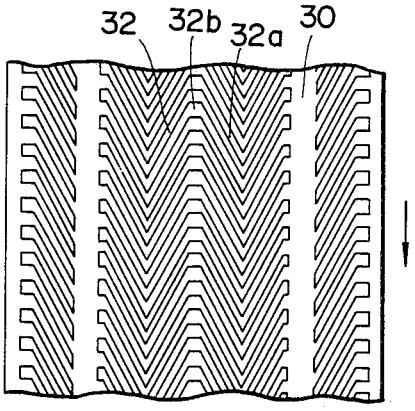

As seen in FIGS. 10 and 11, the air-accumulating groove 32 has its suction portion **32*a* slowly slanted from the peripheral direction and the compression portion 32*b*** sharply inclined from or perpendicular to the peripheral direction in a manner that air easily enters the air-accumulating groove but hardly escapes from the groove, whereby the air is prevented from flowing backward, allowing the groove to raise the bearing effect.

Figure 14:
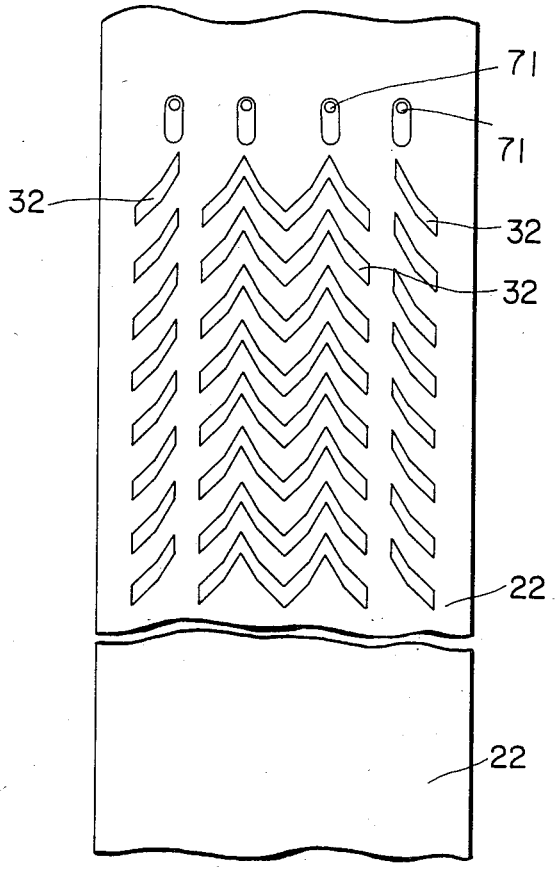
FIG. 14 is a developed view of a part of the inner periphery of the center housing of another embodiment.
Figure 15:
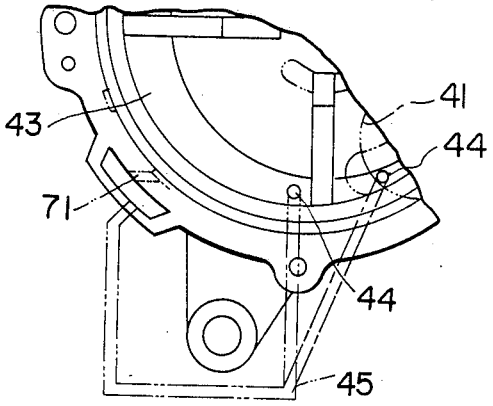
FIG. 15 is a partial view of still a further embodiment, similar to FIG. 1.

As seen in FIG. 14, herringbone air-accumulating grooves 32 can be formed in the compression side inner periphery of the center housing 22 in place of the grooves in the outer periphery of the rotary sleeve. As seen in FIG. 15, the inlet 71 is desirably inclined so as to inject air directly into the air-accumulating groove 32.

As the compressor runs, the rotary 30 sleeve rotates with the rotor 10. Air is supplied through the inlets 71 to the air-bearing room 40 from the compression working space 43. The inlet 71 has a groove peripherally extending toward the downstream side and opens to the suction portion of the air-accumulating groove 32 so that the air smoothly enters the suction portion of the groove and then flows to the compression portion in which it is compressed to increase the bearing capacity of the air-bearing room 40. The inner periphery of the center housing has no inlet nor pocket aligned with the compression portions of the air-accumulating grooves 32. This means that the compression portion permanently maintains the maximum pressure in the groove 32 to improve the bearing effect of the air-bearing room 40. The upstream leaked air enters the pocket 72 above the inlet 71 to allow the pocket to increase the bearing effect of the air-bearing room. The pocket 72 is especially effective in improving the initial running characteristics of the compressor.

Figure 12:
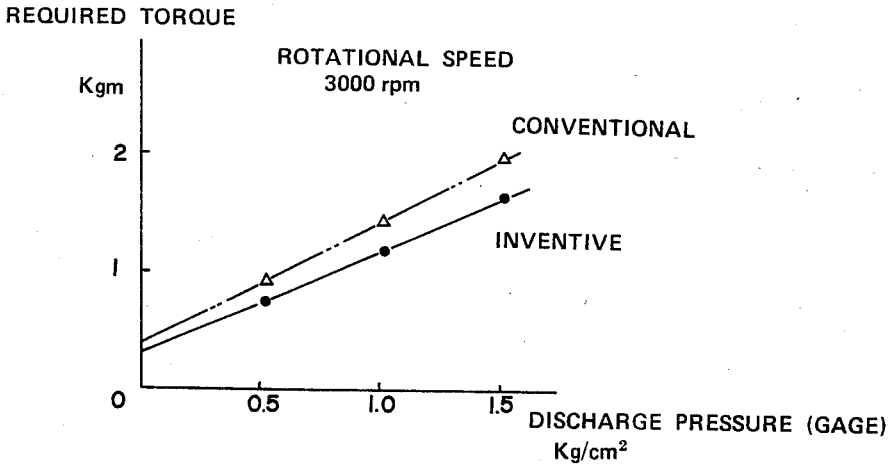
FIGS. 12 and 13 are graphs showing the results of a comparative test on the inventive and conventional compressors.
Figure 13:
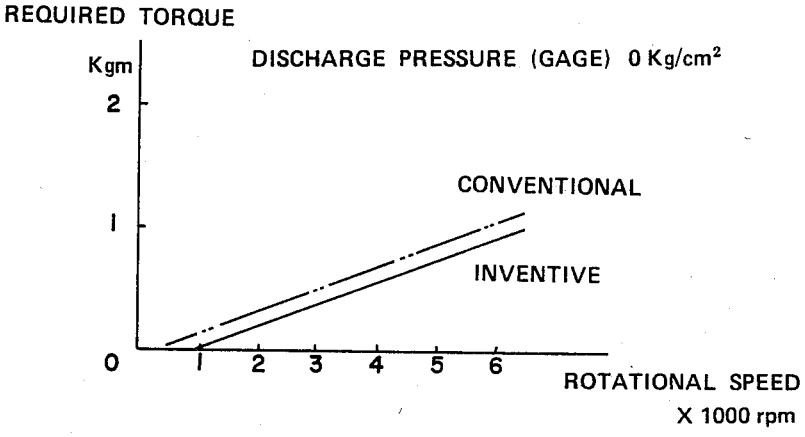

FIGS. 12 and 13 show the results of a comparative test on the compressor provided with the same rotary sleeve as shown in FIG. 4, the particulars being as follows:

capacity: 600 cc/rev.
eccentricity of rotor: 9 mm
outer diameter of rotor: 88 mm
outer diameter of rotary sleeve: 114 mm
inner diameter of rotary sleeve: 106 mm
axial length of rotary sleeve: 115 mm
number of vanes: 4

Figure 6:
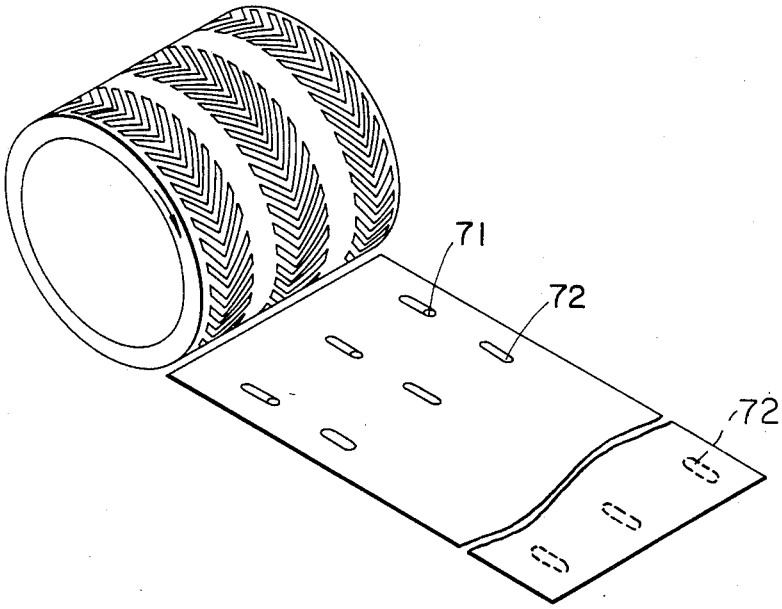

The inventive and conventional are similar to each other except for the inlet. The conventional has its inlets disposed apart from given peripheral lines passing through the suction portions of the air-accumulating grooves, the inlet being as follows:

number of inlets: 2
inner diameter of inlet: 4 mm
axial width of inlet opening: 42.5 mm
peripheral width of inlet opening: 4 mm
pocket: none The inventive has the same inlets as shown in FIG. 6, the particulars being as follows:

number of inlet: 3
inner diameter of inlet: 2 mm
axial width of inlet opening: 4 mm
peripheral width of inlet opening: 15 mm axial width of pocket: 4 mm
peripheral width of pocket: 10 mm
depth of pocket: 0.1 mm The graphs of FIGS. 12 and 13 show a relation between required torque and discharge pressure when the compressor runs at a constant speed and that between rotational speed and required torque when it runs at a constant load, respectively. It is apparent from the graphs that the inventive compressor has an improved bearing periormance because of requiring torque less than the conventional.

What is claimed is:

1. A rotary compressor provided with a center housing, a rotary sleeve mounted for rotation in said center housing, a rotor eccentrically disposed in said rotary sleeve, said rotor being provided with a plurality of vanes movable therein, an air-bearing room disposed between the outer periphery of said rotary sleeve and the inner periphery of said center housing, a multiplicity of air-accumulating grooves formed in the outer periphery of said rotary sleeve and separated from one another, a discharge chamber, and at least one inlet formed on the compression side, inner periphery of said center housing and internally connected to the compression working space confined among said rotary sleeve, air-bearing room, said rotor and said adjacent vanes to supply air to said air-bearing room, said center housing being formed in the inner periphery of the rotary compressor with at least one pocket disposed at the upstream position of and peripherally aligned with said inlet, and said air-accumulating grooves having the suction portion thereof peripherally aligned with said inlet.

2. A rotary compressor provided with a center housing, a rotary sleeve mounted for rotation in said center housing, a rotor eccentrically disposed in said rotary sleeve, said rotor being provided with a plurality of vanes movable therein, an air-bearing room disposed between the outer periphery of said rotary sleeve and the inner periphery of said center housing, a multiplicity of air-accumulating grooves formed in both the inner periphery of said center housing and the outer periphery of said rotary sleeve and separated from one another, a discharge chamber, and at least one inlet formed on the compresssion side, inner periphery of said center housing and internally connected to both said discharge chamber and the compression working space confined among said rotary sleeve, air-bearing room said rotor and said adjacent vanes to supply air to said air-bearing room, said center housing being formed in the inner periphery of the rotary compressor with at least one pocket disposed at the upstream position of and peripherally aligned with said inlet, and said air-accumulating grooves having the suction portion thereof peripherally aligned with said inlet.

3. A rotary compressor provided with a center housing, a rotary sleeve mounted for rotation in said center housing, a rotor eccentrically disposed in said rotary sleeve, said rotor being provided with a plurality of vanes movable therein, an air-bearing room disposed between the outer periphery of said rotary sleeve and the inner periphery of said center housing, a multiplicity of air-accumulating grooves formed in the inner periphery of said center housing and separated from one another, a discharge chamber, and at least one inlet formed on the compression side, inner periphery of said center housing and internally connected to said discharge chamber, air-bearing room, said rotor and said adjacent vanes to supply air to said air-bearing room, said center housing being formed in the inner periphery of the rotary compressor with at least one pocket disposed at the upstream position of and peripherally aligned with said inlet, and said air-accumulating grooves having the suction portion thereof peripherally aligned with said inlet.

4. The rotary compressor as claimed in claim 3, wherein said inlet is inclined toward the downstream direction.

5. The rotary compressor as claimed in claim 3, wherein said air-accumulating groove has a compression portion more sharply inclined from the peripheral direction than said suction portion.

6. The rotary compressor as claimed in claim 5, wherein said compression portion is perpendicular to the peripheral direction.

7. The rotary compressor as claimed in claim 1, wherein said center housing has the inner periphery thereof provided with at least a pocket peripherally aligned with said inlet.

8. The rotary compressor as claimed in claim 7, wherein said air-accumulating groove has a compression portion more sharply inclined from the peripheral direction than said suction portion.

9. The rotary compressor as claimed in claim 3, wherein said inlet is shaped in the form of a peripherally extending groove.

10. The rotary compressor as claimed in claim 9, wherein said air-accumulating groove has a compression portion more sharply inclined from the peripheral direction than said suction portion.

11. The rotary compressor as claimed in claim 9, wherein said inlet is inclined toward the downstream direction.

* * * * *